US007409184B2

(12) United States Patent
Kuwahara et al.

(10) Patent No.: US 7,409,184 B2
(45) Date of Patent: Aug. 5, 2008

(54) ORIGINAL DOCUMENT READING DEVICE

(75) Inventors: Tomohiro Kuwahara, Osaka (JP); Toshihide Higashimori, Osaka (JP); Kouichi Kimura, Osaka (JP); Hidehiro Tabuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 309 days.

(21) Appl. No.: 11/258,071

(22) Filed: Oct. 26, 2005

(65) Prior Publication Data

US 2007/0092317 A1 Apr. 26, 2007

(51) Int. Cl.
*G03G 15/00* (2006.01)

(52) U.S. Cl. ..... 399/365; 399/367; 399/377; 399/81; 399/82; 271/9.08

(58) Field of Classification Search ..... 399/365
See application file for complete search history.

(56) References Cited

U.S. PATENT DOCUMENTS

2004/0240916 A1 * 12/2004 Takata et al. ..... 399/367

FOREIGN PATENT DOCUMENTS

JP 54-87217 A 7/1979

* cited by examiner

*Primary Examiner*—Ren Yan
*Assistant Examiner*—Andy L Pham
(74) *Attorney, Agent, or Firm*—Global IP Counselors, LLP

(57) ABSTRACT

When an original document is placed on the lift tray, a timer is reset and starts counting a predetermined time (S12). Whether an alignment device is moved to adjust the original documents loaded on the lift tray in, for example, the widthwise direction transverse to the transportation direction is then determined (S13). If a change in the detected width of the original documents is detected (S13 returns Yes), control returns to S12 and the timer is reset and started again (S12). If there is no change in the detected width of the original documents in S13, control waits for the timer set in S12 to time out (S14). If the timer reaches the predetermined time set in S12 (S15 returns Yes), the lift tray is driven up by the lift motor (S16) and rises until the top limit sensor turns on (S17).

4 Claims, 5 Drawing Sheets

ORIGINAL DOCUMENT READING DEVICE

FIELD OF THE INVENTION

The present invention relates generally to an original document reading device, and relates more particularly to an original document reading device disposed in a photocopier or facsimile machine, for example, for scanning an original document on a document table.

BACKGROUND INFORMATION

The timing at which the pickup roller picks an original document from the document table in a conventional original document reading device is controlled to the moment at which the roller contacts the top of the document held on the document table after the pickup roller begins descending. This shortens the time between the start of pickup roller movement and paper feeding, and thus improves the paper feed rate.

Another example of a conventional original document reading device has a stack height sensor for sensing the thickness of a stack of original documents placed on the document table. This original document reading device determines how far to move the lift plate based on the detected stack height, and then drives and stops a motor to raise or lower the lift plate the determined distance and thus prevent damage to the device when a problem with the lift plate is detected.

To improve the ease of use for the operator, the operating mode of the original document lifting member in yet another example of a conventional original document reading device can be selectively set to either of two modes: a first operating mode in which the original document lifting member rises immediately after an original is placed on the paper feeding table, and a second operating mode in which the original document lifting member rises when the start button is pressed after detecting that an original document is on the paper feeding table.

These conventional original document reading devices address the need to improve the paper feed rate, prevent damage to the document table, and improve the ease of use to some degree, but these reading devices are not necessarily easy to use.

The present invention is directed to these problems, and an object of the invention is to provide an original document reading device that is easier for the operator to use.

SUMMARY OF THE INVENTION

An original document reading device according to this invention has an original document tray on which original documents are loaded; an original document loading detection means for determining if an original document was loaded on the original document tray; a timer for detecting a predetermined timeout after the original document loading detection means determines that an original document was loaded; a means for moving the original document tray to or away from a paper feeding unit for feeding the original documents; and a control means for moving the original document tray to the paper feeding unit after the time passage detection means detects passage of the predetermined time.

Preferably, the original document tray has an alignment device for aligning the original document edges that are transverse to the transportation direction of the original document; the control means has a movement detection means for determining if the alignment device was moved; and the control means controls moving the original document tray away from the paper feeding unit when the control means determines that the alignment device was moved.

Further preferably, the original document tray has an alignment device for aligning the original document edges that are transverse to the transportation direction of the original document; the control means has a movement detection means for determining if the alignment device was moved; and the control means resets timeout detection by the timer when the control means determines that the alignment device was moved.

Yet further preferably, the original document reading device also has a reset button; and a reset button evaluation means for determining if the reset button was pressed; and the control means controls moving the original document tray away from the paper feeding unit when the reset button is pressed.

Yet further preferably, the predetermined timeout is user settable.

An original document reading device according to another aspect of the invention has an original document tray on which original documents are loaded, the original document tray having an alignment device for aligning the original document edges that are transverse to the transportation direction of the original document; a means for moving the original document tray to or away from a paper feeding unit for feeding the original documents; a movement detection means for determining if the alignment device was moved; and a control means for controlling moving the original document tray away from the paper feeding unit when the movement detection means determines that the alignment device was moved.

An original document reading device according to yet another aspect of the invention has an original document tray on which original documents are loaded; a means for moving the original document tray to or away from a paper feeding unit for feeding the original documents; a reset button; a reset button evaluation means for determining if the reset button was pressed; and a control means for controlling moving the original document tray away from the paper feeding unit when the reset button is pressed.

Further preferably, the original document reading device also has a timer for determining if a predetermined time passed after the control means moved the original document tray away from the paper feeding unit; and the control means moves the original document tray to the paper feeding unit when the timer determines that the predetermined time passed.

Yet further preferably, the control means moves the original document tray slightly away from the paper feeding unit after moving the original document tray to the paper feeding unit.

The original document tray in the present invention thus does not move the original document to the paper feeding unit until a predetermined time is detected to have passed since the original document is loaded. In other words, the user can freely add or align the original documents during this predetermined time.

As a result, an original document reading device that is very easy for the user to use can be provided.

In another aspect of the invention the original document tray is moved away from the paper feeding unit when the alignment device is moved. Because the alignment device is moved when the user adds original documents or realizes that the original document images are not aligned, the original document tray is moved away from the paper feeding unit so that the user can easily perform these tasks.

As a result, an original document reading device that is even easier for the user to use can be provided.

In yet another aspect of the invention the original document tray is moved away from the paper feeding unit when the reset button is pressed. Because the reset button is pressed when the user realizes an original document is missing or decides to add another original document, the original document tray is moved away from the paper feeding unit so that the user can easily perform these tasks.

As a result, an original document reading device that is even easier for the user to use can be provided.

DETAILED DESCRIPTION OF THE PREFERRED EMBODIMENTS

Figure 1:
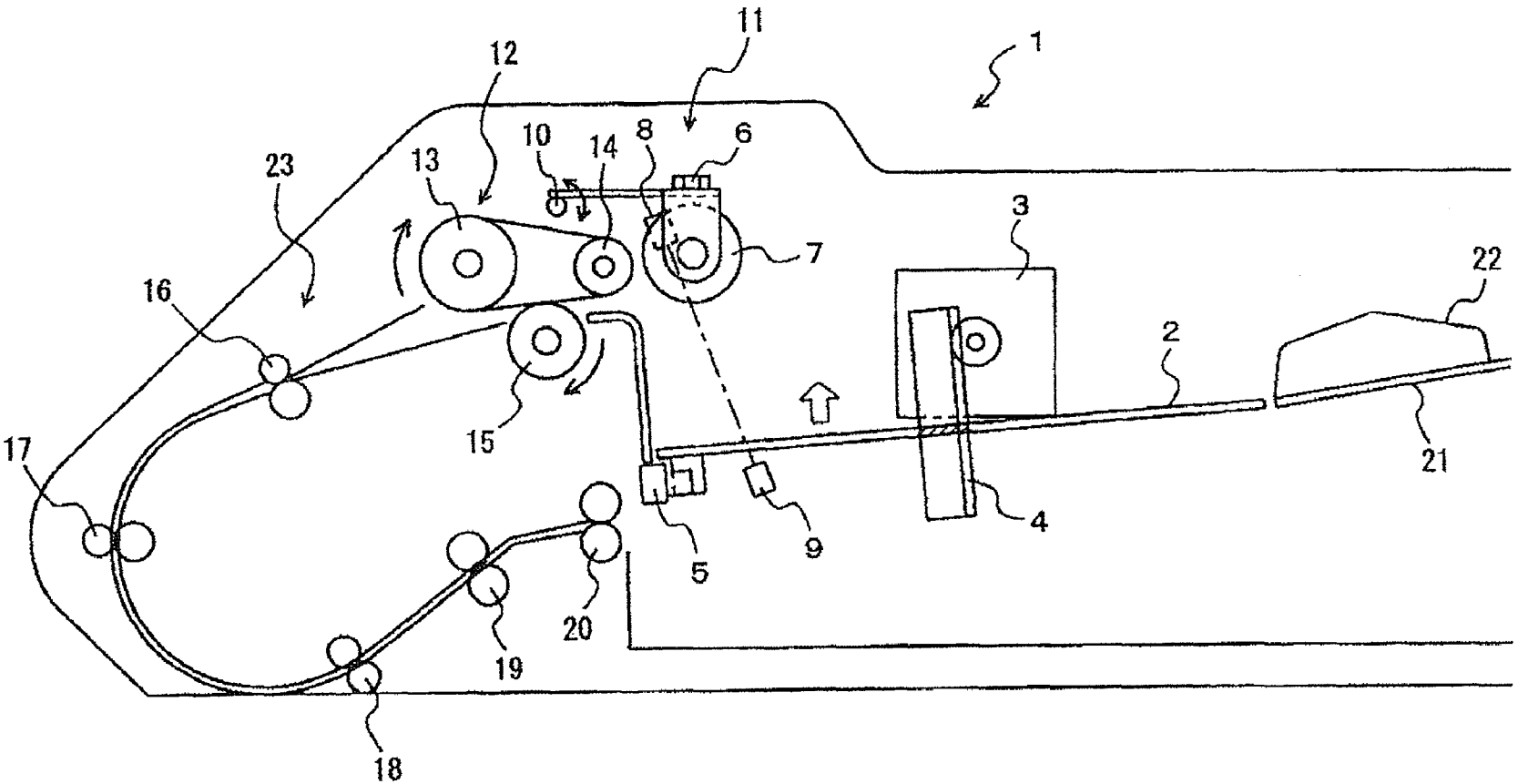
FIG. 1 is a section view of an original document reading device.

Preferred embodiments of the present invention are described below with reference to the accompanying figures. FIG. 1 is a schematic section view showing the arrangement of an original document reading device according to a preferred embodiment of the invention.

As shown in FIG. 1, this original document reading device 1 has a lift tray (original document tray) 2 on which the original documents are placed. A lift motor 3 drives a rack 4 to raise and lower the lift tray 2 and thereby raise and lower the original documents placed on the lift tray 2. A bottom limit sensor 5 detects the lower limit position of the lift tray 2, and a top limit sensor 6 detects the upper limit position of the lift tray 2. The top limit sensor 6 is disposed above a paper feeding roller 7. An optical emitter 8 for detecting whether or not an original document is located on lift tray 2 is disposed near the paper feeding roller 7, and an opposing optical receptor 9 is disposed below the lift tray 2.

The light output from the optical emitter 8 passes through a hole (not shown) formed in the lift tray 2. An original document placed on the lift tray 2 blocks the passage of light from the optical emitter 8, thereby enabling the optical receptor 9 to detect that an original document is present.

The paper feeding roller 7 can pivot up and down on pivot point 10 to contact the topmost original document placed on the lift tray 2 and convey the document into the paper feeding unit 11. A slide resistor not shown is disposed to the lift tray 2, and the number of original documents is detected based on the resistance of this slide resistor when the paper feeding roller 7 contacts the originals. The paper feeding roller 7 is normally held at a position above the height of the maximum paper capacity of the lift tray 2.

A separation unit 12 for separating a single document from the stack is disposed to the paper feeding unit 11 so that multiple originals are not conveyed into the transportation unit 23 together. The separation unit 12 includes rollers 13 and 14, and a roller 15 that rotates in the opposite direction as rollers 13 and 14. The transportation unit 23 also has a plurality of feed roller pairs 16, 17, 18, 19, and 20 for conveying the original documents one at a time.

A paper feeding table 21 is disposed behind the lift tray 2. A pair of alignment devices 22 disposed to the paper feeding table 21 is set to the width of the original documents loaded on the lift tray 2 and paper feeding table 21 to align the document edges that are perpendicular to the paper feeding direction. When a document is loaded so that the paper is fed in the longitudinal direction and the user sets the pair of alignment devices 22 against the edges of the document that are transverse to the paper feeding direction, the original document reading device can know the size of the original document. Note that only one side of the pair of alignment devices 22 is shown in FIG. 1.

Figure 2:
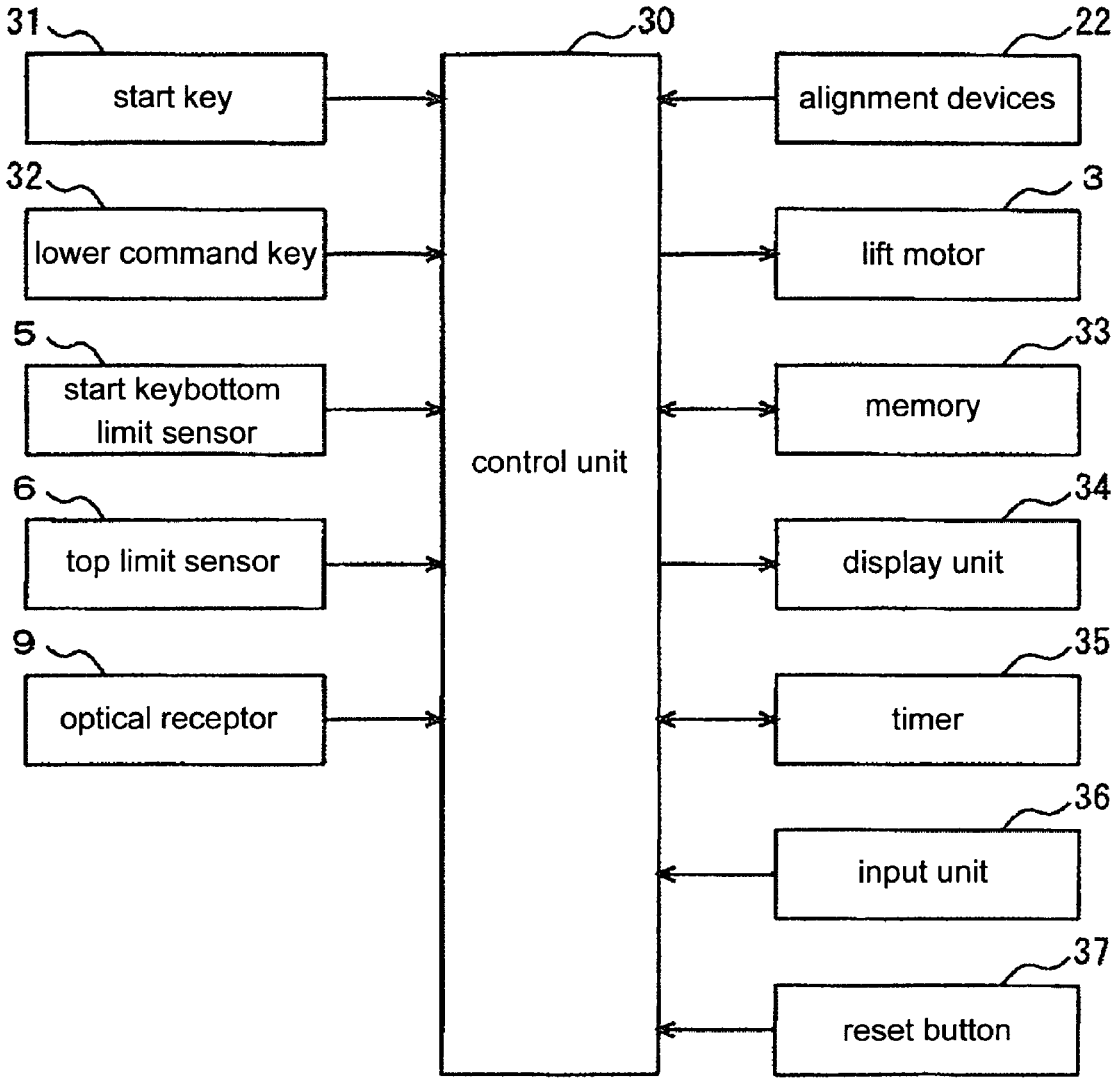
FIG. 2 is a block diagram of an original document reading device.

FIG. 2 is a block diagram of the original document reading device according to this embodiment of the invention.

As shown in FIG. 2, the lift motor 3, bottom limit sensor 5, top limit sensor 6, optical receptor 9, and alignment devices 22 shown in FIG. 1 are connected to the control unit 30 (control means). Also disposed to the control unit 30 are a start key 31, lower command key 32, memory 33, display unit 34, timer 35, input unit 36, and reset button 37.

When operated by the user the start key 31 outputs a command to start the original document reading process, and the lower command key 32 outputs a command to move the lift tray 2 to the lowest position. This lowest position is set so that, for example, a maximum 200 original documents can be placed on the lift tray 2. The position to which the lift tray 2 is set can be displayed on the display unit 34 so that, for example, the user can easily determine if the lower command key 32 must be pressed when copying a large number of documents.

The control unit 30 determines if the lift tray 2 has been lowered to the lowest position from the output of the bottom limit sensor 5, determines if the lift tray 2 has been raised to the highest position from the output of the top limit sensor 6, and determines if an original document is on the lift tray 2 from the output of the optical receptor 9.

The timer 35 is used to set the time until the lift motor 3 is driven to raise the lift tray 2 to lift the documents on the lift tray 2 to the paper feeding unit 11 in order to feed the documents after the user places the original documents on the lift tray 2.

User settings can be entered from the input unit 36 to control the operation of the original document reading device. A keypad, touch screen or panel, or other type of input device can be used for the input unit 36. The user can set the value counted by the timer 35 as further described below using, for example, a rotating dial-type input unit 36.

The reset button 37 is used to move and reset the lift tray 2 to the lowest position after documents have been placed on the lift tray 2 and the lift tray 2 has been raised to the paper feeding unit 11. Note that the lower command key 32 could be used as the reset button 37.

(1) First Embodiment

Figure 3:
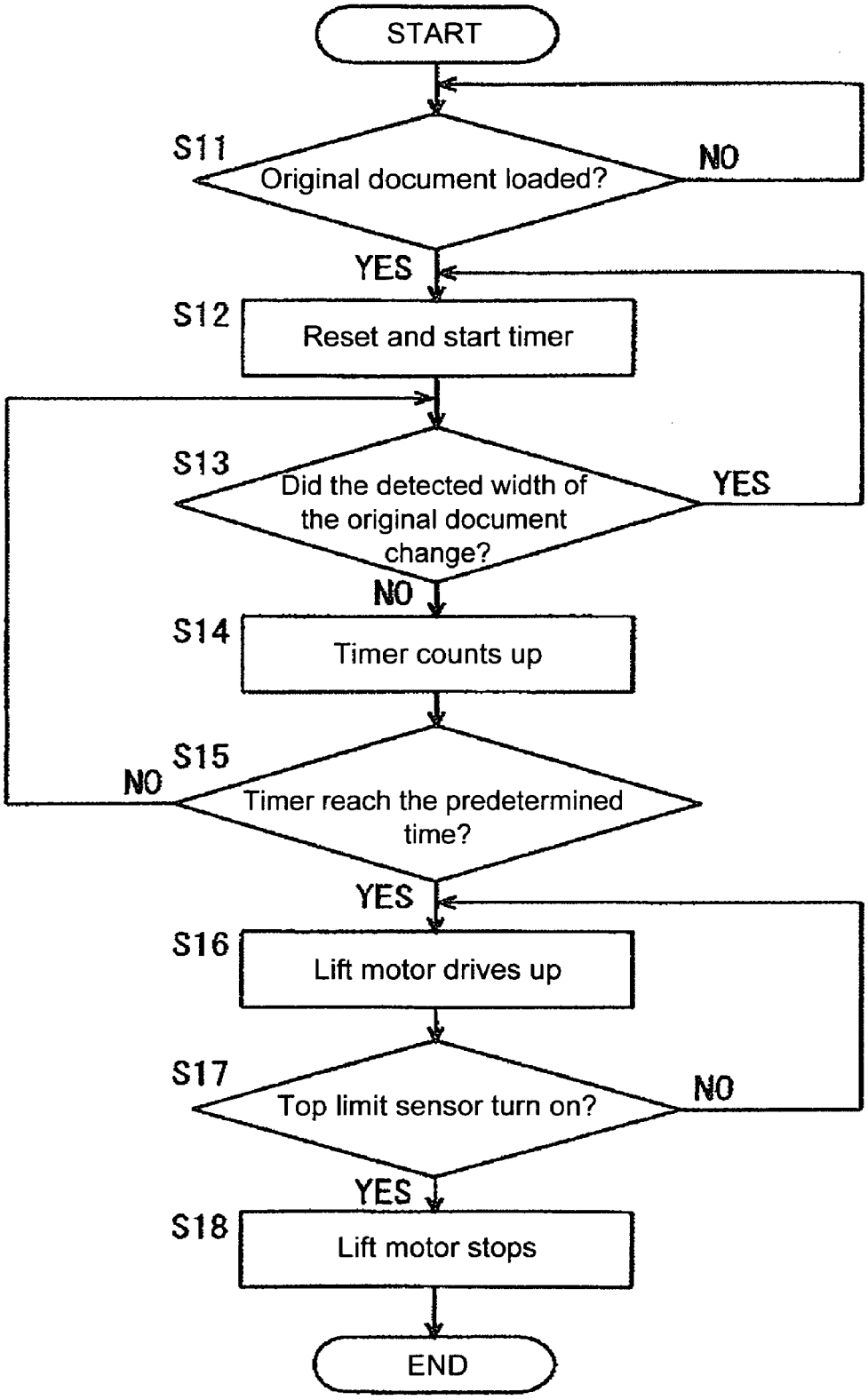
FIG. 3 is a flow chart describing the operation of an original document reading device according to a preferred embodiment of the invention.

The operation of the original document reading device 1 is described next. FIG. 3 is a flow chart describing the operation of the original document reading device 1 in this first embodiment of the invention.

Referring to FIG. 3, operation first waits for an original document to be placed on the lift tray 2 (step S11). Once an original is placed on the lift tray 2, the timer 35 is reset to start counting a predetermined time (S12). Whether the alignment devices 22 have been moved and adjusted to the document sides that are transverse to the transportation direction of the original document placed on the lift tray 2 is then determined (S13). If the detected width of the original document changes (S13 returns Yes), control returns to step S12 and the timer 35 is reset and restarted (S12). If there is no change in the detected width of the original document (S13 returns No), the timer set in step S12 advances (S14).

When the timer times out at the predetermined time set in S12 (S15 returns Yes), the lift tray 2 is raised by the lift motor 3 (S16) until the top limit sensor 6 turns on (S17). When the top limit sensor 6 turns on, the lift motor 3 stops (S18).

If step S15 returns No, steps S13 to S15 repeat until the timer 35 reaches timeout. As a result, the positioning of the documents can be adjusted using the alignment devices 22 and more documents can be added to the stack until the timer times out at the predetermined setting.

The user can use the input unit 36 to adjust the predetermined setting of the timer 35 as desired in step S12. The setting is then stored in memory 33.

As described above, the original documents are not supplied to the paper feeding unit 11 for a predetermined time after the documents are placed on the lift tray 2 in this embodiment of the invention. The user can therefore add more documents and perform other document tasks for a predetermined time, and a user-friendly, easy-to-use original document reading device can thus be provided.

(2) Second Embodiment

Figure 4:
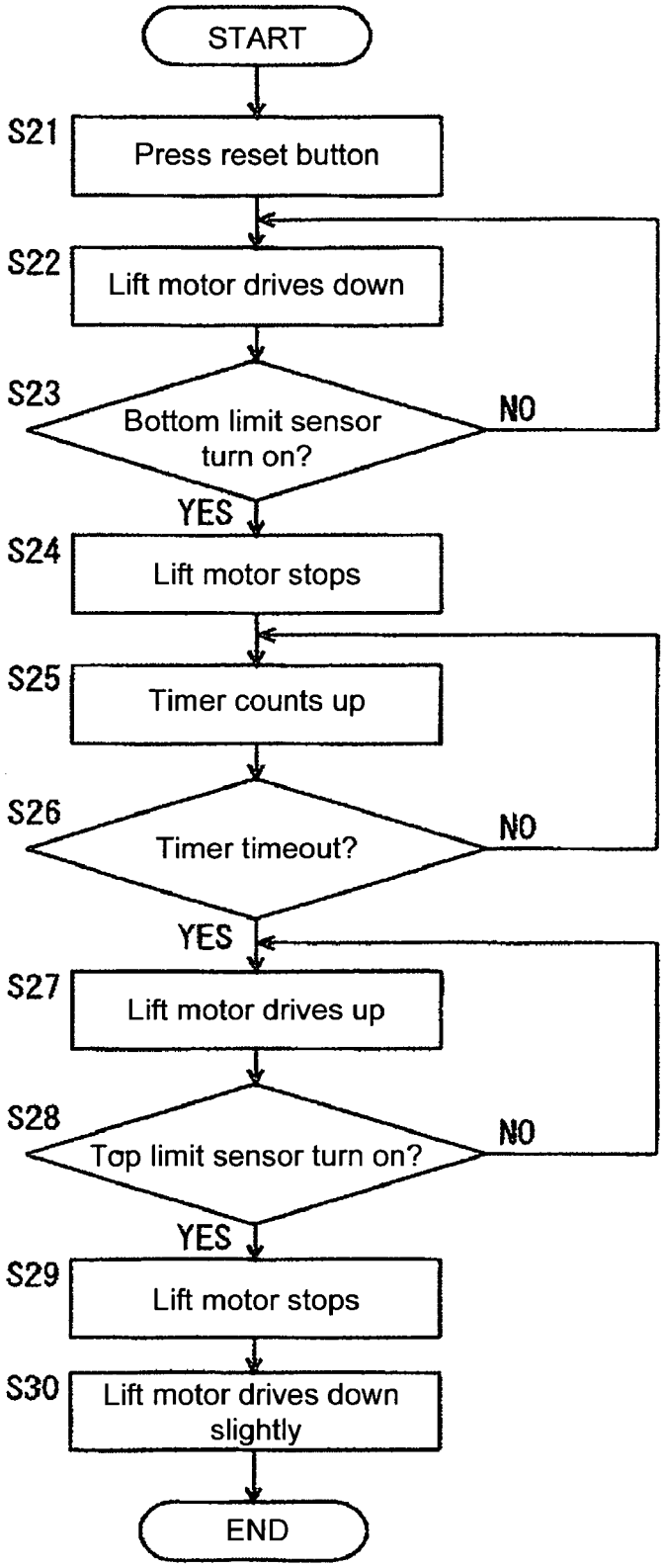
FIG. 4 is a flow chart describing the operation of an original document reading device according to another embodiment of the invention.

A second embodiment of the present invention is described next below. FIG. 4 is a flow chart describing the operation of the original document reading device 1 in this second embodiment of the invention.

Referring to FIG. 4, the lift tray 2 immediately raises the original documents to the paper feeding unit 11 when the user places the original documents on the lift tray 2 in this embodiment of the invention. After stopping the lift motor 3, the control unit 30 then reverses the lift motor 3 to lower the lift tray 2 slightly and create a gap between the original documents and paper feeding roller 7.

If the user then notices that not all original documents have been loaded or that the edges of the original documents are not aligned, for example, and presses the reset button 37 (S21), the lift motor 3 lowers the lift tray 2 until the bottom limit sensor 5 turns on (S22, S23) and the lift motor 3 then stops (S24).

The control unit 30 then waits for the timer 35 to time out, and the lift motor 3 then drives the lift tray 2 to rise until the top limit sensor 6 turns on (S25 to S27). When the lift tray 2 detects the top limit sensor 6 (S28 returns Yes), the lift motor 3 stops (S29), and the lift motor 3 is then driven to descend slightly and lower the lift tray 2 slightly (S30). This creates a gap between the paper feeding roller 7 and original documents so that, for example, the user can reposition the original documents.

As described above, the lift tray 2 descends to the bottom limit position when the user presses the reset button 37 in this embodiment of the invention. As a result, if after placing the original documents on the lift tray 2 the user notices that not all original documents were loaded, for example, the user can easily take appropriate action such as adding the missing original documents or rearranging the original documents on the lift tray 2.

After the lift tray 2 reaches the bottom limit position and the lift motor 3 stops, the lift tray 2 rises to the paper feeding unit 11 only after the predetermined time passes, and the user can therefore perform desired tasks during this delay period.

The user can also freely set the timeout period of the timer 35 as desired in this embodiment of the invention.

(3) Third Embodiment

Figure 5:
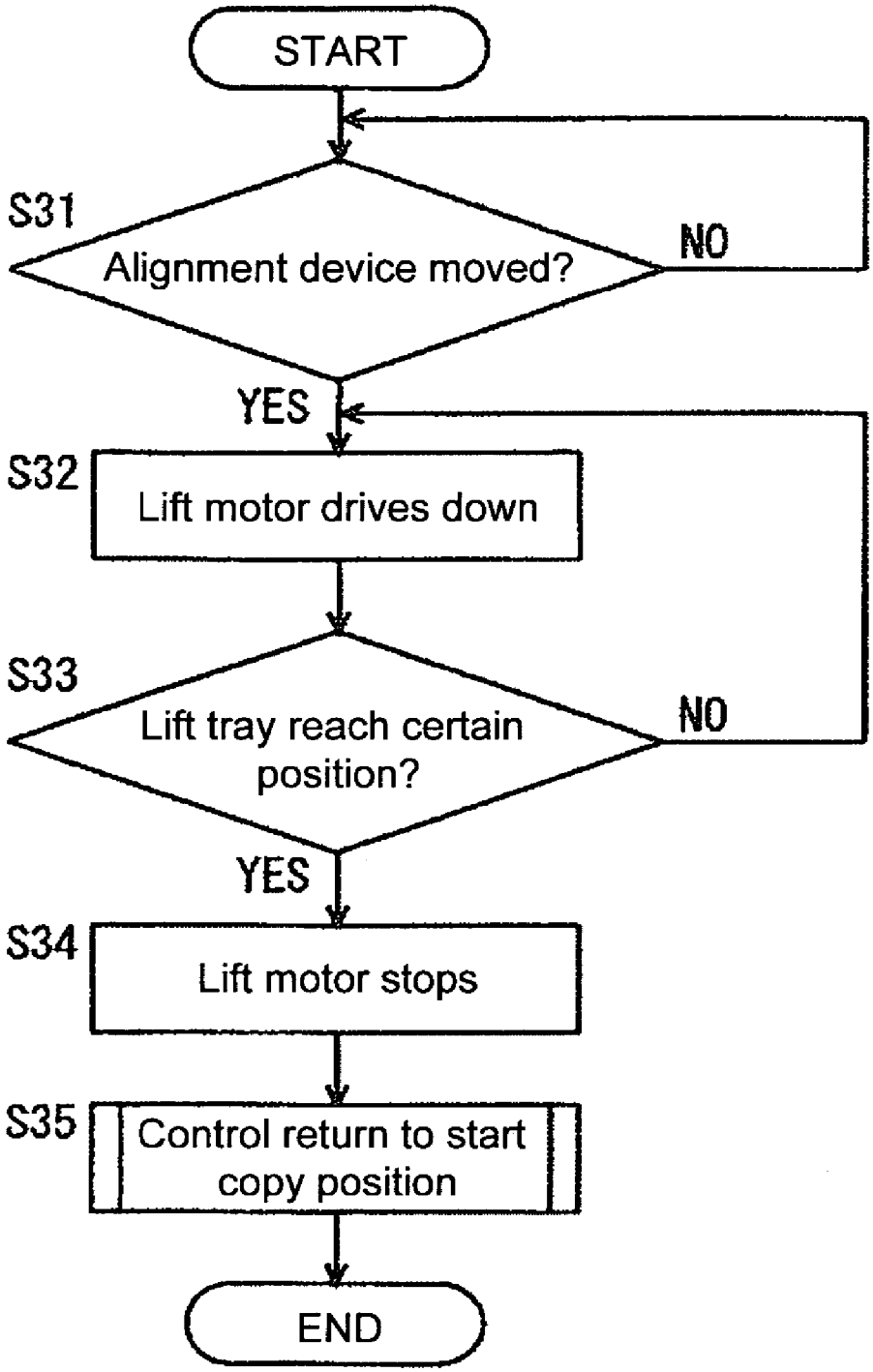
FIG. 5 is a flow chart describing the operation of an original document reading device according to yet another embodiment of the invention.

A third embodiment of the present invention is described next below. FIG. 5 is a flow chart describing the operation of this third embodiment of the invention.

Referring to FIG. 5, when the original documents are placed on the lift tray 2, the lift motor 3 raises the lift tray 2 until the top limit sensor turns on. The control unit 30 then determines whether or not the alignment devices 22, which align the document edges that are transverse to the transportation direction of the original documents, were moved (S31). If the control unit 30 determines that the alignment devices 22 were moved (S31 returns Yes), the lift motor 3 is driven to descend (S32) and lower the lift tray 2 to a certain position (S33). When the lift tray 2 has descended to this certain position, the lift motor 3 stops (S34).

In other words, this embodiment of the invention lowers the lift tray 2 so that the user can easily reset the original documents if the control unit 30 determines that the alignment devices 22 were moved because movement of the alignment devices 22 means that the user is adjusting the original documents. An original document reading device that is easy for the user to use can thus be provided.

The invention can also be arranged so that the user can further lower the lift tray 2 if the position to which the tray has descended is still not enough. The reset button 37 described in the previously described embodiment can be used to control this operation, or the lower command key 32 can be used. Further alternatively, a message such as "lower the tray further?" and corresponding response buttons could be presented on the display unit so that the user can respond accordingly.

An arrangement enabling the operator to use the input unit 36 to set the position to which the lift tray 2 descends is also possible. This descent position can also be expressed as a number of sheets of paper. This descent position can also be the bottom limit position.

After this operation is completed, control goes to the step of returning the lift tray 2 to the start-copy position (S35).

The control process, shown in step S35, of returning the lift tray 2 to the start-copy position is described next using the first embodiment described above.

After the lift tray 2 is lowered to the certain position and the operator adds or arranges the original documents, the lift tray 2 can be raised to the paper feeding unit 11 when the set predetermined time has passed after the original documents are placed on the lift tray 2 as described in the first embodiment so that copying can then start soon. As a result, copying, for example, can start quickly.

It will be noted that the invention can be arranged so that the operator can select a processing mode that performs only the steps preceding step S35, and a processing mode that includes step S35 and later. This selection can be made using information presented on the display unit 34.

Preferred embodiments of the present invention are described above with reference to the accompanying figures, but the invention will not be limited to the embodiments shown in the figures. The embodiments shown in the figures can be modified and varied in many ways without departing from the scope of this invention.

What is claimed is:

1. An original document reading device comprising:

an original document tray on which original documents are loaded;

an original document loading detection means for determining if an original document was loaded on the original document tray;

a timer for detecting a predetermined timeout after the original document loading detection means determines that an original document was loaded;

input means for adjusting and readjusting by a user the length of the predetermined timeout of the timer;

a means for moving the original document tray to or away from a paper feeding unit for feeding the original documents; and a control means for moving the original document tray to the paper feeding unit after the timer reaches the predetermined timeout.

2. The original document reading device according to claim 1, wherein the original document tray comprises an alignment device for aligning the original document edges that are transverse to the transportation direction of the original document, the control means comprises a movement detection means for determining if the alignment device was moved, and the control means controls moving the original document tray away from the paper feeding unit when the control means determines that the alignment device was moved.

3. The original document reading device according to claim 1, wherein the original document tray comprises an alignment device for aligning the original document edges that are transverse to the transportation direction of the original document, the control means comprises a movement detection means for determining if the alignment device was moved, and the control means resets timer timeout detection when the control means determines that the alignment device was moved.

4. The original document reading device according to claim 1, further comprising a reset button, and a reset button evaluation means for determining if the reset button was pressed, wherein the control means controls moving the original document tray away from the paper feeding unit when the reset button is pressed.

* * * * *